US007191828B2

(12) United States Patent
Arizmendi et al.

(10) Patent No.: US 7,191,828 B2
(45) Date of Patent: Mar. 20, 2007

(54) HYDRAULICALLY SET CONCENTRIC PACKER WITH MULTIPLE UMBILICAL BYPASS THROUGH THE PISTON

(75) Inventors: Napoleon Arizmendi, Magnolia, TX (US); Brett W. Bouldin, Spring, TX (US)

(73) Assignee: WellDynamics, Inc., Spring, TX (US)

( * ) Notice: Subject to any disclaimer, the term of this patent is extended or adjusted under 35 U.S.C. 154(b) by 277 days.

(21) Appl. No.: 10/847,931

(22) Filed: May 18, 2004

(65) Prior Publication Data

US 2005/0257928 A1 Nov. 24, 2005

(51) Int. Cl.
*E21B 33/12* (2006.01)

(52) U.S. Cl. ..... 166/65.1; 166/120

(58) Field of Classification Search ..... 166/65.1, 166/179, 120

See application file for complete search history.

(56) References Cited

U.S. PATENT DOCUMENTS 3,002,559 A * 10/1961 Hanes ..... 166/63
3,066,736 A * 12/1962 Venghiattis ..... 175/4.52
4,798,243 A 1/1989 Curington et al.
5,044,433 A 9/1991 Rubbo et al.
5,044,441 A 9/1991 Rubbo et al.
5,316,094 A * 5/1994 Pringle ..... 175/74
5,425,418 A 6/1995 Arizmendi et al.
5,636,689 A 6/1997 Rubbo et al.
6,026,897 A * 2/2000 Pringle et al. ..... 166/65.1
6,532,839 B1 * 3/2003 Kluth et al. ..... 73/866.5
6,609,567 B2 * 8/2003 Ingram et al. ..... 166/126

OTHER PUBLICATIONS

Petroleum Engineering Services Drawing No. 308181-00, dated Nov. 27, 2000.
Halliburton Energy Services Drawing No. 12 AHR 71619-F, dated Sep. 17, 2003.

* cited by examiner

*Primary Examiner*—Hoang Dang
(74) *Attorney, Agent, or Firm*—Smith IP Services, P.C.

(57) ABSTRACT

A hydraulically set concentric packer with multiple umbilical bypass through the piston. In a described embodiment, a packer for use in a subterranean well includes a piston which displaces to set the packer in the well, and a line extending through the piston. The piston has concentric inner and outer diameters, and is concentric with an inner mandrel and an outer housing of the packer.

46 Claims, 4 Drawing Sheets

HYDRAULICALLY SET CONCENTRIC PACKER WITH MULTIPLE UMBILICAL BYPASS THROUGH THE PISTON

BACKGROUND

The present invention relates generally to equipment utilized and operations performed in conjunction with a subterranean well and, in an embodiment described herein, more particularly provides a hydraulically set concentric packer with multiple umbilical bypass through a piston of the packer.

It has long been desired to provide a convenient and economical method of extending umbilicals (such as hydraulic, electrical and/or fiber optic lines) through packers in subterranean wells. The lines could merely pass through the interior of an inner mandrel of a packer, but then the lines would interfere with flow and access through the packer, and the lines would be exposed to damage from tools, abrasive fluids, etc. passing through the packer.

One proposed solution to this problem is to install a sleeve within the mandrel, and position the lines between the sleeve and the mandrel. The sleeve would protect the lines from damage. Unfortunately, the presence of the sleeve restricts flow and access through the packer.

Another proposed solution is to extend the lines through a sidewall of the inner mandrel or an outer housing of the packer. However, this requires the mandrel or housing to have an increased wall thickness, which reduces the available cross-sectional area in the packer for flow area or, in the case of a hydraulically set packer, for actuator piston area. If the actuator piston area is reduced, then the available setting force is consequently reduced.

To provide sufficient piston area where the lines are extended through the outer housing, the housing may be provided with an eccentric bore (i.e., greater wall thickness on one side as compared to an opposite side of the housing). Unfortunately, this either requires the inner mandrel to be offset to one side in the housing (which in turn causes tubing connected above and below the packer to be laterally offset), or requires that the piston also be eccentrically formed. Each of these is undesirable for operational and/or manufacturing cost reasons.

Therefore, it will be appreciated that there is a need for improved ways of extending lines through packers and through actuators for packers. These improvements could find use in other applications, as well.

SUMMARY

In carrying out the principles of the present invention, in accordance with an embodiment thereof, a packer and an associated actuator are provided which conveniently and economically provide for extending lines through the packer and/or actuator in a well.

In one aspect of the invention, a packer for use in a subterranean well is provided. The packer includes a piston which displaces to set the packer in the well. A line, such as a hydraulic, electrical or fiber optic line, extends through the piston. The piston preferably has concentric inner and outer diameters, and is concentric with an inner mandrel and an outer housing of the packer.

In another aspect of the invention, a packer for use in a subterranean well includes a piston and an outer housing. The outer housing is sealingly engaged with the piston and reciprocably disposed relative to a seal element. Displacement of the outer housing relative to the piston outwardly extends the seal element. A line extends through a wall of the piston.

In yet another aspect of the invention, an actuator for a well tool positioned in a subterranean well is provided. The actuator includes a piston reciprocably disposed in the actuator, such that displacement of the piston in response to a pressure differential across a wall of the piston is operative to cause actuation of the actuator. A line extends through the piston wall.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
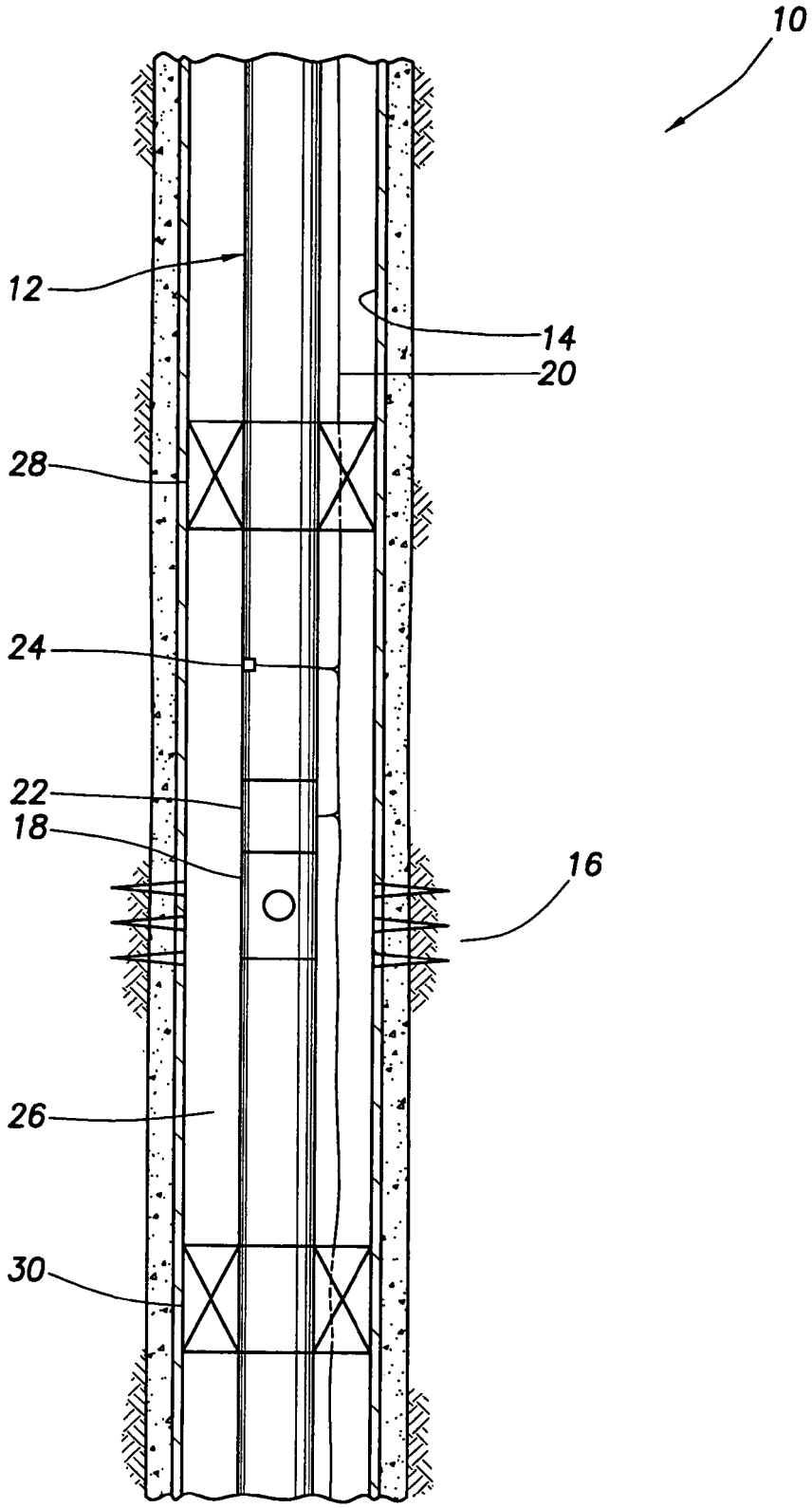
FIG. 1 is a schematic partially cross-sectional view of a well tool system embodying principles of the present invention.

Representatively illustrated in FIG. 1 is a well tool system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, a production tubing string 12 has been installed in a wellbore 14 for the purpose of producing fluid from a formation or zone 16 intersected by the wellbore. Note that it is not necessary in keeping with the principles of the invention for a production tubing string to be used, or for fluid to be produced from a formation. Other types of tubular strings could be used, fluid could be injected instead of, or in addition to, being produced, etc. Thus, it is to be clearly understood that the system 10 is described herein as merely one example of the vast number of applications for the principles of the invention, which are not limited in any way to the details of the system 10.

A flow control device 18 (such as a valve or choke) is interconnected in the tubing string 12 to regulate flow of the fluids between the formation 16 and the interior of the tubing string. Operation of the flow control device 18 is monitored and controlled from a remote location (such as the earth's surface or another location in the well) via lines 20 which extend between the remote location and an actuator 22 for the flow control device. For example, the lines 20 could include one or more hydraulic lines to hydraulically operate the actuator 22 or, if the actuator is electrically operated, the lines could include one or more electrical lines.

The actuator 22 could include a position sensor to monitor the position of a closure member (such as a sliding sleeve or choke device) of the flow control device 18. Other sensors, such as temperature sensors, pressure sensors, etc., could be used. The lines 20 could include one or more fiber optic lines to operate the sensors and/or to transmit data from the sensors. Electrical lines could be used for this purpose, as well.

It is not necessary for the lines 20 to be connected only to the actuator 22. The lines 20 could also, or alternatively, be connected to a sensor 24 apart from the actuator 22. Thus, it should be clearly understood that the lines 20 can be of any type, can be used for any purpose, and can be connected to any type of well tool, in keeping with the principles of the invention.

An annulus 26 formed radially between the tubing string 12 and the wellbore 14 is closed off or blocked above and below the flow control device 18 by packers 28, 30 interconnected in the tubing string and set in the wellbore. Since at least the upper packer 28 is positioned between the flow control device 18 and the remote location, it is desired for the lines 20 to extend through the packer, without compromising the function of the packer, and without causing extraordinary inconvenience and expense. The lines 20 could also extend through the lower packer 30, for example, to another flow control device, sensor, etc. below the lower packer, in which case the convenient and economical extension of the lines through the lower packer would also be desirable.

The system 10 accomplishes these objectives by providing the packers 28, 30 and their associated actuators with a unique method of extending the lines through the packers and their actuators. Examples are described below, but it should be clearly understood that the principles of the invention are not limited to the details of these specific examples.

Figure 2A:
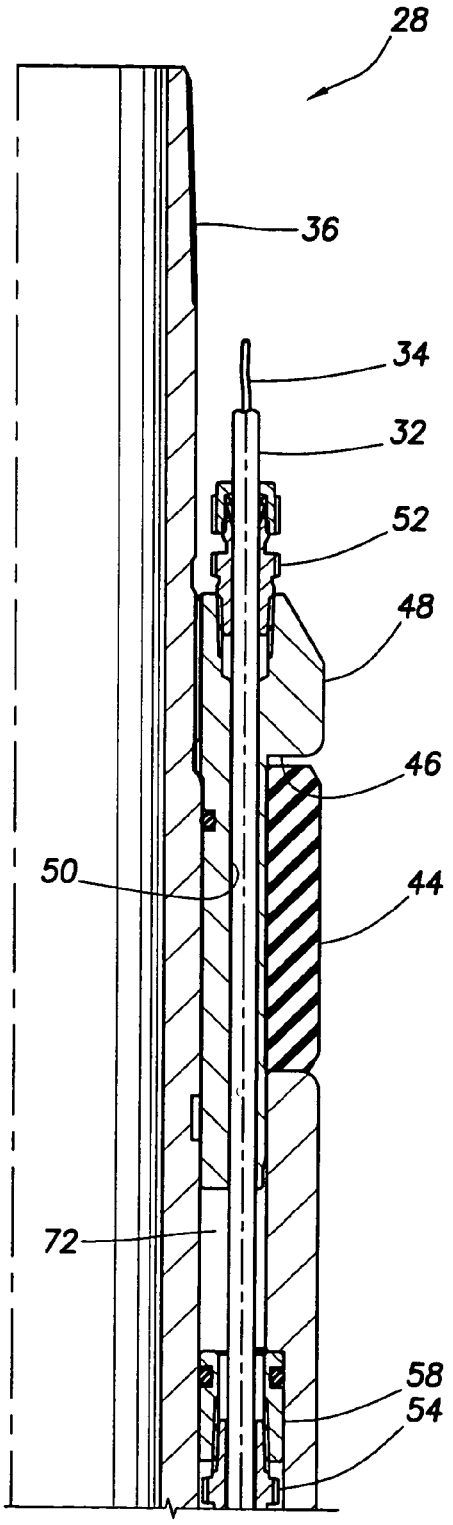
FIGS. 2A & B are enlarged scale quarter-sectional views of successive axial sections of a packer used in the system of FIG. 1, the packer embodying principles of the invention.

Referring now to FIGS. 2A & B, an enlarged quarter-sectional view of the packer 28 is representatively illustrated. In this view, the manner in which a hydraulic line 32, which has another line 34 therein, extends through the packer 28 can be seen. For example, the line 34 could be an electrical line or a fiber optic line within the hydraulic line 32. Note that any number of lines, and any types of lines, can extend through the packer 28 in keeping with the principles of the invention.

The packer 28 includes an inner tubular mandrel 36 having threaded connections at each end for interconnection in the tubing string 12. A tubular outer housing 38 is reciprocably disposed relative to an annular piston 40. The piston 40 is sealingly received in a bore 42 of the housing 38, and is positioned radially between the mandrel 36 and the housing. The piston 40 is sealingly and rigidly attached to the exterior of the mandrel 36.

An annular seal element 44 is positioned above the housing 38, between an upper end of the housing and a downwardly facing shoulder 46 on a connector sub 48. The connector sub 48 is sealingly and rigidly attached to the exterior of the mandrel 36.

The lines 32, 34 extend longitudinally through an opening 50 formed through the connector sub 48. A compression ferrule-type tubing fitting 52 sealingly secures the line 32 to the connector sub 48. Another such fitting 56 sealingly secures the line 32 at a lower end of the piston 40. The lines 32, 34 extend longitudinally through an opening 60 formed through the piston 40.

To set the packer 28, a pressure differential is applied longitudinally across a wall 62 of the piston 40. For example, pressure within the mandrel 36 may be increased by applying pressure to the tubing string 12 at the surface. This pressure is communicated to an upper end of the piston 40 via an opening 64 formed through a sidewall of the mandrel 36. A lower end of the piston 40 is exposed to pressure in the annulus 26 about the packer 28 via another opening 66 formed through a sidewall of the housing 38.

The difference in pressure across the wall 62 of the piston 40 biases the piston (and mandrel 36) downwardly relative to the housing 38. Alternatively, it could be considered that the difference in pressure biases the housing 38 upwardly relative to the piston 40 (and mandrel 36). Shear pins, shear screws, etc. or other conventional releasing devices may be used to prevent relative displacement between the housing 38 and the piston 40 until a predetermined pressure differential is achieved.

When the housing 38 displaces upwardly relative to the piston 40, the seal element 44 will be axially compressed between the upper end of the housing and the shoulder 46. This axial compression will cause the seal element 44 to extend radially outward into sealing contact with the wellbore 14, thereby setting the packer 28. An internally toothed ratchet device 68 grips the exterior of the piston 40 and prevents the housing 38 from displacing downwardly once it has displaced upwardly relative to the piston.

Another compression ferrule-type tubing fitting 54 is connected to the ring 58. However, instead of securing the line 32 to the ring 58, the fitting 54 sealingly secures a tube 70 to the ring. The tube 70 extends downwardly from the fitting 54 and into the opening 60 in the piston 40. The tube 70 is sealingly and reciprocably received in the opening 60.

The lines 32, 34 extend longitudinally through the tube 70. As the housing 38 displaces upward relative to the piston 40, the ring 58, fitting 54 and tube 70 can also displace upward with the housing. However, since the tube 70 is sealed in the piston 40, the tube's wall continues to isolate pressure on the top of the piston (communicated from the interior of the mandrel 36 via the opening 64) from pressure in the opening 60, and from pressure in the annular space 72 above the ring 58 and radially between the mandrel 36 and the housing 38.

Note that the piston 40 has an outer diameter PD which is concentric with an inner diameter Pd of the piston. Each of these diameters PD, Pd is also concentric with inner and outer diameters Md, MD of the mandrel 36. Similarly, each of these diameters Pd, Pd, MD, Md is concentric with inner and outer diameters Hd, HD of the housing 38.

Thus, the packer 28 does not require any of the mandrel, housing and piston 36, 38, 40 to be eccentric with respect to any of the others in order for the lines 32, 34 to extend through the packer. Yet, the piston 40 is provided with a relatively large piston area and the lines 32, 34 are protected within the packer 28, without restricting flow or access through the mandrel 36.

Figure 2B:
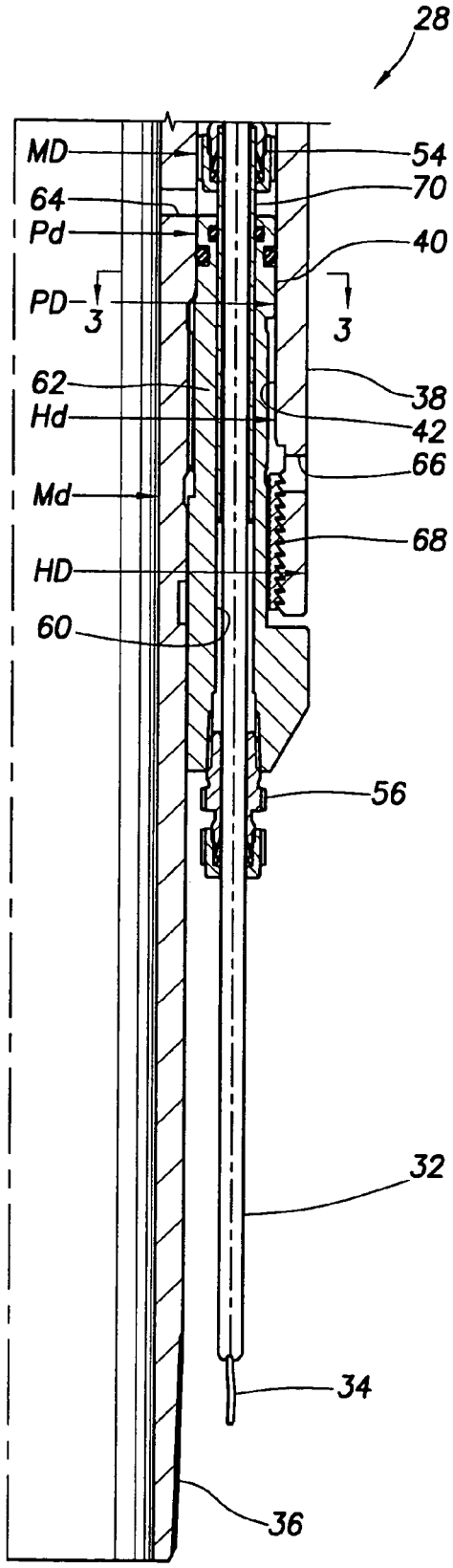
Figure 3:
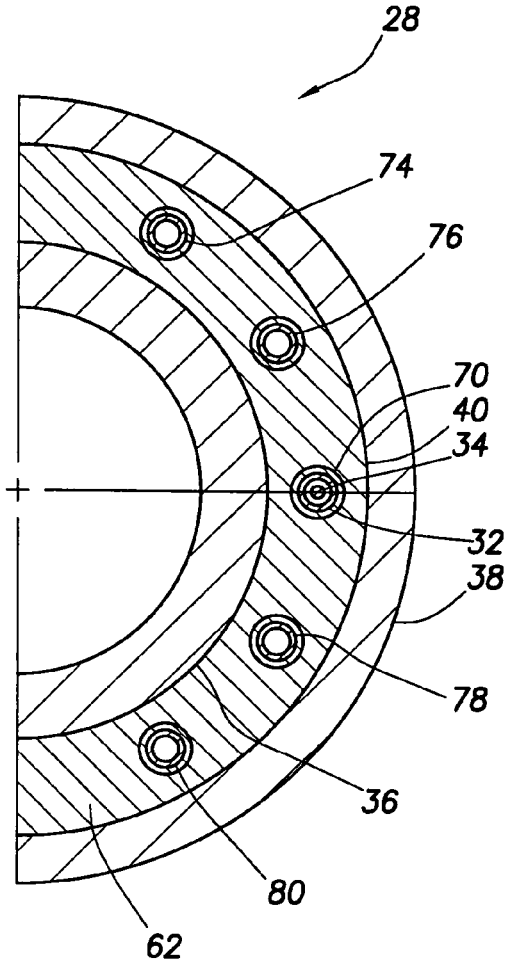
FIG. 3 is a further enlarged scale quarter-sectional view of the packer, taken along line 3—3 of FIG. 2B.

Referring additionally now to FIG. 3, a quarter-sectional view of the packer 28 is representatively illustrated, taken along line 3—3 of FIG. 2B. In this view it may be seen that the packer 28 can include additional lines 74, 76, 78, 80 extending through the wall 62 of the piston 40. These lines 74, 76, 78, 80 can be any types of lines, and any number of lines may be used.

Figure 4A:
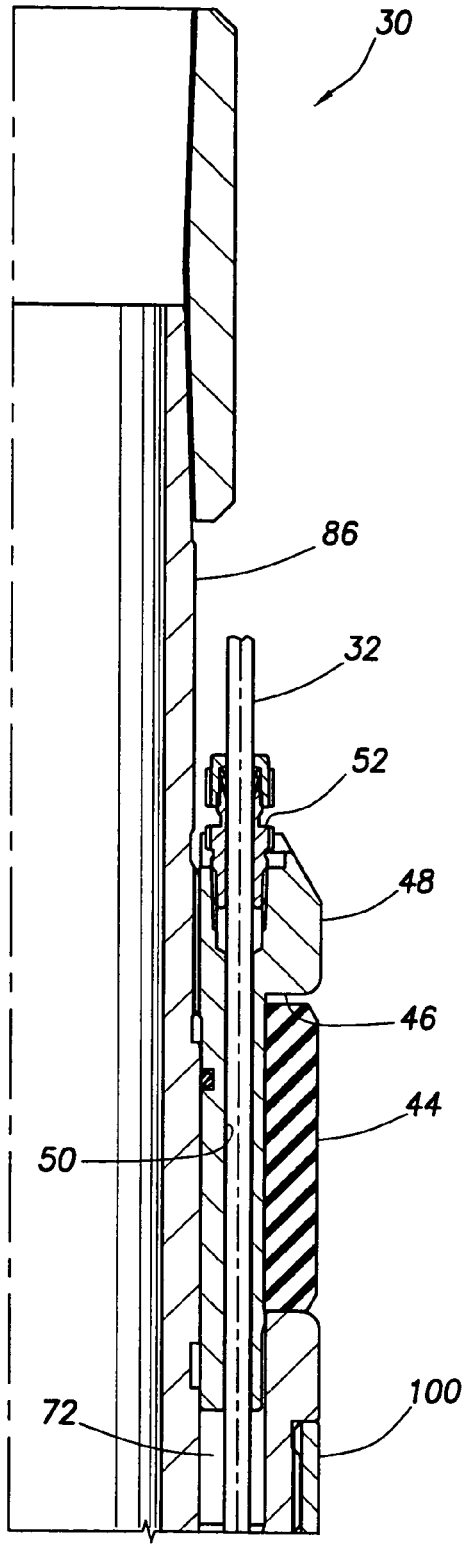
FIGS. 4A–C are quarter-sectional views of successive axial sections of another packer used in the system of FIG. 1, the packer embodying principles of the invention.
Figure 4B:
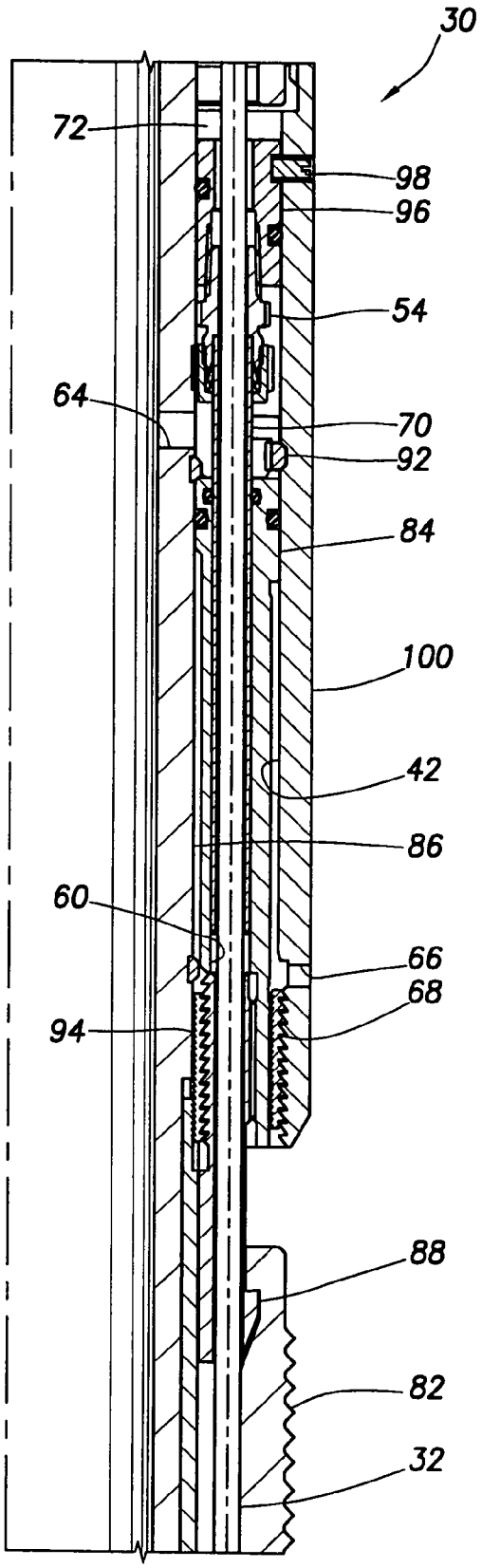
Figure 4C:
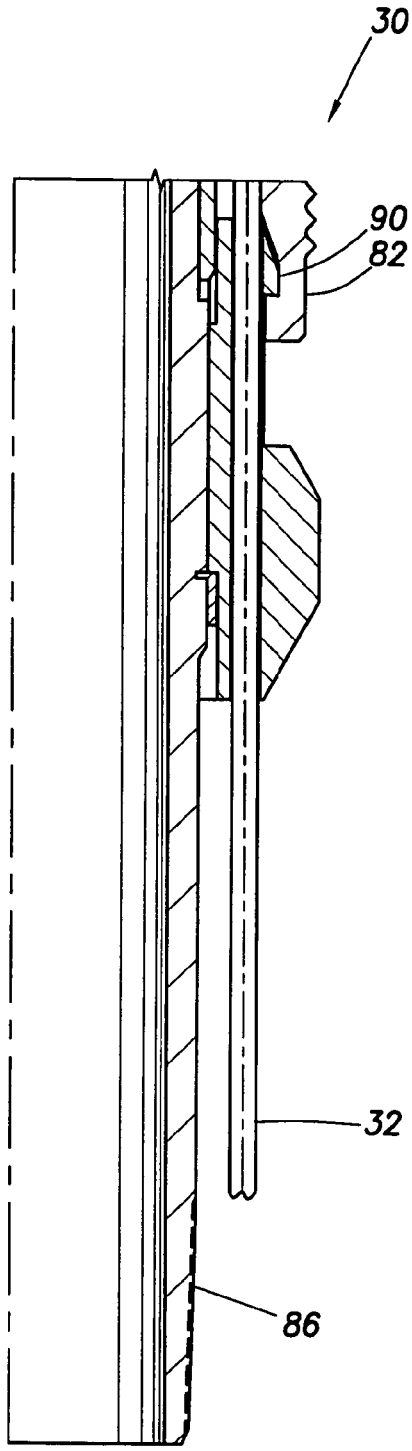

Referring additionally now to FIGS. 4A–C, a quarter-sectional view of the packer 30 is representatively illustrated. The packer 30 is similar in many respects to the packer 28 described above, and so elements shown in FIGS. 4A–C which are similar to those described above are indicated using the same reference numbers.

One substantial difference between the packers 28, 30 is that the packer 30 includes slips 82 (only one of which is visible in FIGS. 4B & C) for anchoring the packer in the wellbore 14. Another substantial difference is that a piston 84 of the packer 30 is not rigidly attached to an inner mandrel 86. Instead, the piston 84 displaces downwardly relative to the mandrel 86 when the packer 30 sets.

This downward displacement of the piston 84 relative to the mandrel 86 pushes an upper wedge 88 downward also, causing the slips 82 to be displaced radially outward by inclined surfaces on the upper wedge and on a lower wedge go at a lower end of the slips. The upper wedge 88 is prevented from displacing upward by an internally toothed ratchet 94 once the upper wedge has displaced downwardly relative to the mandrel 86.

Yet another substantial difference is that the packer 30 includes an anti-preset device 92 which prevents setting of the packer until an appropriate pressure level is applied to an upper side of the piston 84 via the opening 64. Once the pressure level is attained, the device 92 releases and permits the packer 30 to be set. This prevents external loads applied to the packer 30 during run-in from causing the packer to set prematurely.

Note that the packer 30 includes a ring 96 which is somewhat similar to the ring 58 of the packer 28. One or more shear screws 98 releasably secures the ring 96 in position. However, when pressure transmitted to the top of the piston 84 via the opening 64 exceeds pressure in the annulus 26 by a predetermined amount, the screws shear and the ring 96 displaces upward, thereby releasing the anti-preset device 92.

As with the packer 28, the packer 30 has a concentric piston 84, mandrel 86 and outer housing 100. The line 32 extends through the piston 84 within the tube 70, which isolates pressure in the interior of the tubing string 12 (applied to the top of the piston 84 and the exterior of the tube via the opening 64) from pressure in the annulus 26 (applied to the bottom of the piston and to the interior of the tube).

Although the above descriptions of the packers 28, 30 have indicated that tubing pressure is used to set the packers, it will be readily appreciated that other pressure sources could be used. For example, a propellant could be used, the packers could alternatively be set mechanically (such as by manipulation of the tubing string 12), etc. Furthermore, the packers 28, 30 could be released using a shear ring, rotation of the tubing string 12, by milling or cutting, shifting a sleeve, punching a port through the mandrels 36, 86 and applying pressure to a chamber, etc., or by any other method.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A packer for use in a subterranean well, the packer comprising:

a piston which displaces to set the packer in the well; and a line extending through a wall of the piston, the wall being formed between inner and outer diameters of the piston.

2. The packer of claim 1, wherein the outer diameter of the piston is concentric with the inner diameter of the piston.

3. The packer of claim 2, wherein the piston outer diameter is concentric with an inner diameter of an inner mandrel of the packer.

4. The packer of claim 2, wherein the piston outer diameter is concentric with an outer diameter of an inner mandrel of the packer.

5. The packer of claim 1, wherein the piston displaces relative to an outer housing of the packer to set the packer.

6. The packer of claim 5, wherein the outer diameter of the piston is concentric with an outer diameter of the outer housing.

7. The packer of claim 5, wherein the outer diameter of the piston is concentric with an inner diameter of the outer housing.

8. The packer of claim 1, wherein the line extends through an opening formed through the wall of the piston.

9. The packer of claim 8, wherein a pressure differential applied across the wall biases the piston to displace to set the packer.

10. The packer of claim 8, wherein the line extends through a tube positioned in the opening.

11. The packer of claim 10, wherein the piston displaces relative to the tube to set the packer.

12. The packer of claim 1, wherein the line comprises a hydraulic line.

13. The packer of claim 1, wherein the line comprises a fiber optic line.

14. The packer of claim 1, wherein the line comprises an electrical line.

15. The packer of claim 1, wherein the line comprises a fiber optic line within a hydraulic line.

16. The packer of claim 1, wherein the line comprises an electrical line within a hydraulic line.

17. A packer for use in a subterranean well, the packer comprising:

a piston;

an outer housing sealingly engaged with the piston and reciprocably disposed relative to a seal element, displacement of the outer housing relative to the piston being operative to outwardly extend the seal element; and a line extending through a wall of the piston, the wall being formed between inner and outer diameters of the piston.

18. The packer of claim 17, wherein the line extends through a tube positioned in an opening in the wall of the piston.

19. The packer of claim 18, wherein the tube displaces with the outer housing relative to the piston in response to a pressure differential applied across the wall of the piston.

20. The packer of claim 18, wherein the tube displaces relative to the line in response to a pressure differential applied across the wall of the piston.

21. The packer of claim 18, wherein the line displaces with the piston relative to the tube in response to a pressure differential applied across the wall of the piston.

22. The packer of claim 18, wherein the tube is reciprocably disposed in the opening in the wall of the piston.

23. The packer of claim 18, wherein the tube is sealed within the opening, so that a pressure differential applied across the wall to set the packer is also applied across the tube.

24. The packer of claim 17, wherein the outer diameter of the piston is concentric with the inner diameter of the piston.

25. The packer of claim 24, wherein the piston outer diameter is concentric with an inner diameter of an inner mandrel of the packer.

26. The packer of claim 24, wherein the piston outer diameter is concentric with an outer diameter of an inner mandrel of the packer.

27. The packer of claim 17, wherein the outer diameter of the piston is concentric with an outer diameter of the outer housing.

28. The packer of claim 17, wherein the outer diameter of the piston is concentric with an inner diameter of the outer housing.

29. The packer of claim 17, wherein a pressure differential applied across the wall biases the piston to displace to set the packer.

30. The packer of claim 17, wherein the line comprises a hydraulic line.

31. The packer of claim 17, wherein the line comprises a fiber optic line.

32. The packer of claim 17, wherein the line comprises an electrical line.

33. The packer of claim 17, wherein the line comprises a fiber optic line within a hydraulic line.

34. The packer of claim 17, wherein the line comprises an electrical line within a hydraulic line.

35. An actuator for a well tool positioned in a subterranean well, the actuator comprising:

a piston reciprocably disposed in the actuator, displacement of the piston in response to a pressure differential across a wall of the piston being operative to cause actuation of the actuator; and a line extending through the piston wall between inner and outer diameters of the piston, the line including an electrical line within a hydraulic line.

36. The actuator of claim 35, wherein the well tool is a packer, and wherein displacement of the piston is operative to set the packer in the well.

37. The actuator of claim 35, wherein the outer diameter of the piston is concentric with the inner diameter of the piston.

38. The actuator of claim 37, wherein the piston outer diameter is concentric with an inner diameter of an inner mandrel of the actuator.

39. The actuator of claim 37, wherein the piston outer diameter is concentric with an outer diameter of an inner mandrel of the actuator.

40. The actuator of claim 35, wherein the piston displaces relative to an outer housing of the actuator to actuate the actuator.

41. The actuator of claim 40, wherein the outer diameter of the piston is concentric with an outer diameter of the outer housing.

42. The actuator of claim 40, wherein the outer diameter of the piston is concentric with an inner diameter of the outer housing.

43. The actuator of claim 35, wherein the line extends through a tube positioned in the piston wall.

44. The actuator of claim 43, wherein the piston displaces relative to the tube to actuate the actuator.

45. The actuator of claim 35, wherein the line comprises a fiber optic line.

46. The actuator of claim 35, wherein the line further includes a fiber optic line within the hydraulic line.

* * * * *